United States Patent [19]

Hunt et al.

[11] 4,440,262

[45] Apr. 3, 1984

[54] DELAYED DEPLOYMENT PLATFORM

[75] Inventors: Harlley L. Hunt, Midland; Ansel T. Fletcher, Odessa, both of Tex.

[73] Assignee: Ingersoll-Rand Company, Woodcliff Lake, N.J.

[21] Appl. No.: 468,041

[22] Filed: Feb. 22, 1983

[51] Int. Cl.[3] ..... B66C 23/04; B66C 23/62

[52] U.S. Cl. ..... 182/114; 182/142; 182/113; 52/121; 175/85

[58] Field of Search ..... 182/114, 142–144, 182/141, 148, 113; 52/121, 115; 175/85; 212/267

[56] References Cited

U.S. PATENT DOCUMENTS

| | | | |
|---|---|---|---|
| 2,191,643 | 2/1940 | Deckard | 182/114 |
| 2,291,055 | 7/1942 | Ortloff | 182/114 |
| 2,358,755 | 9/1944 | Woody | 182/114 |
| 2,662,797 | 12/1953 | Moon | 182/114 |
| 4,157,129 | 6/1979 | Christopher | 182/114 |
| 4,326,602 | 4/1982 | Bryant | 182/114 |
| 4,393,630 | 7/1983 | Knox | 175/85 |

*Primary Examiner*—R. P. Machado
*Attorney, Agent, or Firm*—Walter C. Vliet

[57] ABSTRACT

Disclosed is a delayed deployment platform or racking board for use on oil well derricks or the like. The automatic system for delayed deployment allows the derrick rack to be utilized with very tall pump jacks or the like. The delayed deployment system does not lower the racking board until the derrick has extended sufficiently for the board to clear tall pump jacks and the like.

6 Claims, 4 Drawing Figures

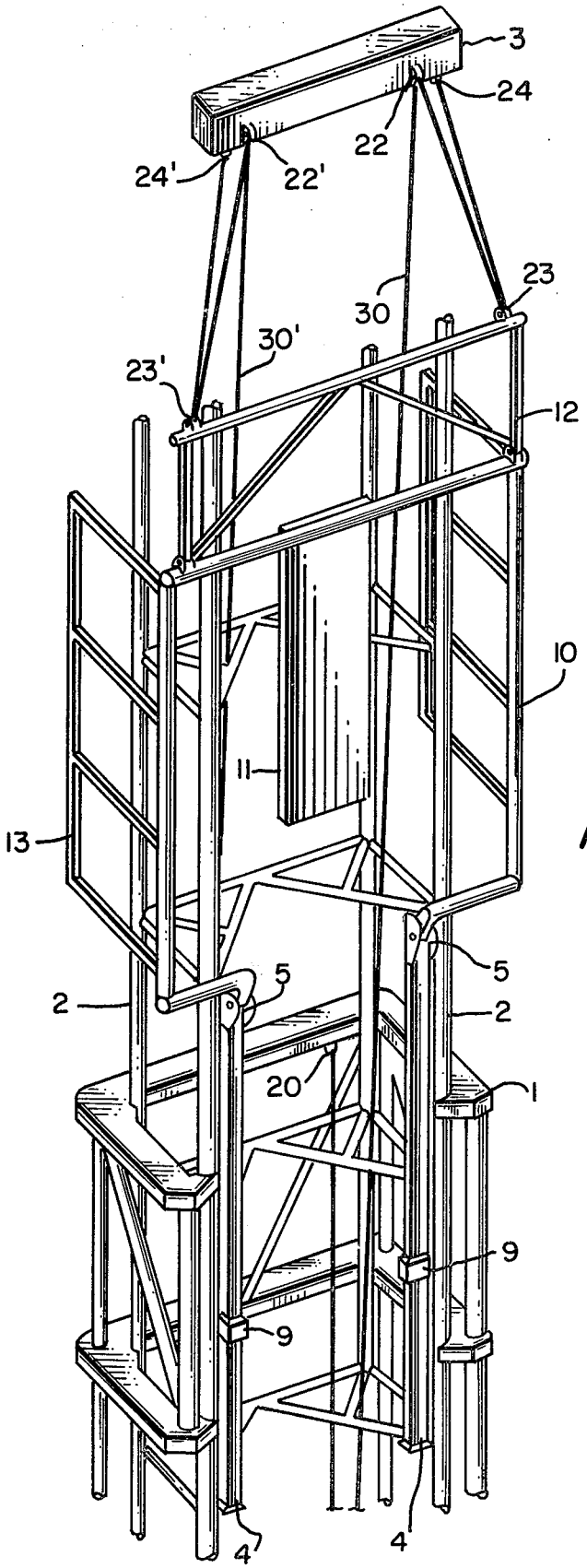
FIG. 1
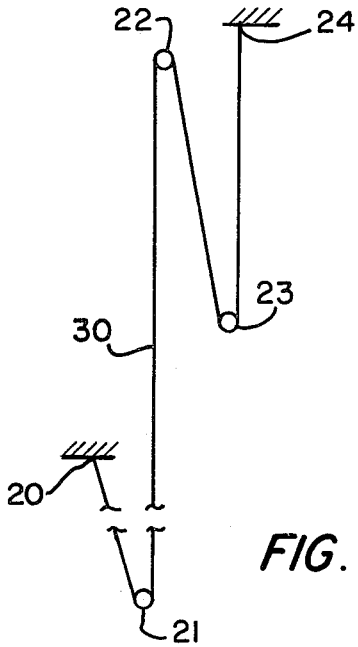
FIG. 4
FIG. 3
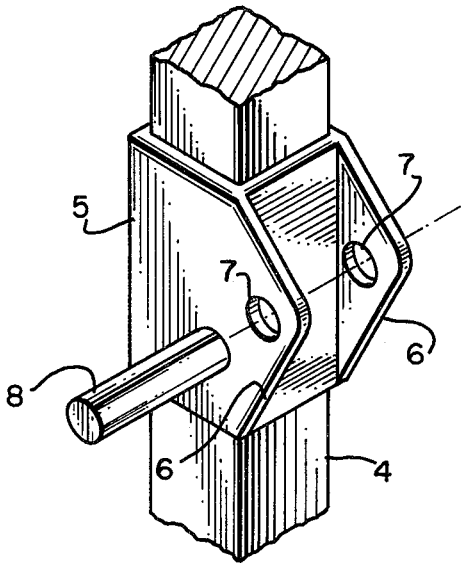

DELAYED DEPLOYMENT PLATFORM

BACKGROUND OF THE INVENTION

Current derricks utilize a system which automatically deploys or lowers the racking board as the derrick is extended. The system results in premature deployment of the racking board where very tall pump jacks or the like are encountered. The automatic deployment system of the present invention delays deployment of the racking board until the derrick has extended sufficiently to clear such pumps jacks or the like.

The object of the present invention is to provide a system for the delayed deployment of the platform or racking board of an extensible derrick. A further object of the invention is to provide a system which automatically deploys the platform or racking board.

Yet a further object of the present invention is to provide a system which is safe, simple, reliable, and economical to manufacture.

These and other objects are obtained in an automatic delayed action deployment system for an extensible derrick comprising a platform attached to a derrick at an upper extensible section by means of at least one sliding hinge point disposed on the extensible section, at least one slide guide for guiding the at least one hinge point and allowing relative movement of the at least one hinge point along the extensible section, a stop means disposed along the at least one slide guide for limiting the relative movement, a means for suspending the platform in a vertical stored position wherein the means for suspending the platform further comprise means for lowering the platform relative to the extensible section to a point where the at least one hinge point coacts with the stop means to further prevent lowering of the platform relative to the extensible section and thereafter permit the platform to rotate about the at least one hinge point to a horizontal deployed position all in automatic response to the raising of the extensible section.

BRIEF DESCRIPTION OF THE DRAWINGS

FIG. 1 is an isometric schematic drawing showing a portion of an extensible derrick having mounted thereon a racking board shown in its stored position.

FIG. 3 shows a detail of a sliding pivotal mount for the racking board according to the present invention.

FIG. 4 is a schematic detail of the cable reeving utilized in the automatic racking board delayed deployment system of the present invention (not to scale).

DESCRIPTION OF THE PREFERRED EMBODIMENT

Figure 2:
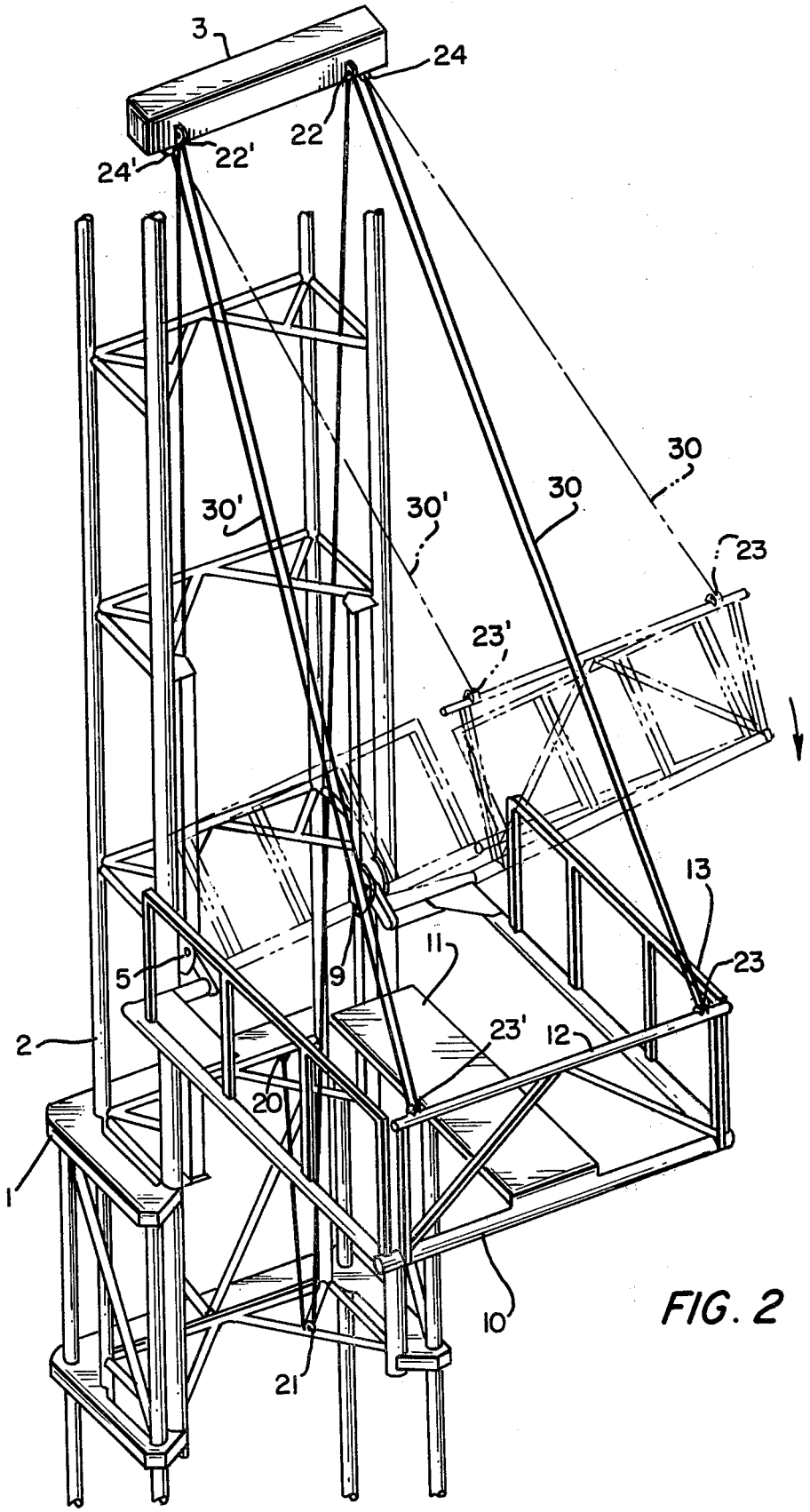
FIG. 2 is an isometric schematic drawing of an extensible derrick according to the present invention having a racking board mounted thereon in its partially deployed (ghost lines) and fully deployed positions.

Referring to FIG. 1, a conventional extensible derrick having a lower section or support tower 1 is shown. Typically, such support towers are provided with an open forward face to permit vertical standing drill pipes, traveling blocks, or the like to pass to the interior of the framework of the tower.

Shown extensibly mounted in the lower section is an upper section or extensible section 2. A crown-beam or cross-beam 3 is shown. The crown-beam would typically be securely mounted to the framework of the extensible section, near the top of the extensible section (mounting and top portion of the extensible section not shown). The forward face of the extensible section is also open for the same reason as the lower section.

Specific details of the derrick frame construction are omitted, but are well known in the art and not critical to the present invention, other than to the extent of an open forward face.

A pair of guide rails 4 are shown mounted to the structure that forms the open front face of the extensible section 2. The guide rails may be of any conventional form, such as I-beam columns or rectangular columns, and are intended as a slide guide for a pivotal mounting of a platform.

In FIG. 1, the pivotal or sliding hinges 5 are shown disposed about the guide rails 4. For purposes of the preferred embodiment, FIG. 3 shows a detail of the sliding hinge 5 disposed about a square guide rail 4. The sliding hinge is comprised of a hollow square section having inside dimensions slightly greater than the outside dimensions of the square guide rail so as to pass freely along the guide rail but without undue looseness.

Along one side of the sliding hinge are two triangular projections 6, each having a bore 7 therethrough for accepting a pivot pin 8 (shown removed in FIG. 3). Also disposed on the guide rails is a stop 9 which may be a hollow square section of slightly larger internal dimensions, similar to the hollow square section of the slide guide, but welded or bolted in place to form an interfering stop on the guide rail. The location of the stop and length of the guide rail depend on the amount of extensible travel of the upper section desired prior to deployment of the platform or racking board.

Shown mounted on the sliding hinges 5 is a typical racking board 10. The racking board is provided with an operator platform 11 and a rotating rail 12, as well as two fixed safety rails 13 as shown in FIG. 2. The racking board 10 is mounted by means of a pivot pin 8 which passes through the bores 7 in the sliding hinges 5.

It should be understood by one skilled in the art that the mounting of the racking board 10 allows the racking board to slide vertically downward until the sliding hinges 5 engage the stop 9, at which point the racking board is free to further rotate only as shown in FIG. 2. The racking board is free to rotate to a horizontal position or deployed position wherein an operator can enter the racking board and stand on the operator platform 11 and perform the desired racking function, that is, storage of drill string pipe or the like.

According to the present invention, the racking board 10 is suspended by means of a reeved cable and block system which will now be described.

As shown in FIG. 1, a first cable attachment point 20 is shown mounted on the lower section or support section 1 near its upper end. A first pulley block 21 is shown mounted on the lower end of the extensible section 2 as best seen in FIG. 2. A second pulley block 22 is shown mounted on crown beam 3. A third pulley block 23 is shown mounted on the rotating rail 12 of the racking board. Finally, a second cable attachment point 24 is shown also mounted to crown beam 3.

A cable 30 is shown reeved from the first cable attachment point 20 successively through the first, second and third pulley blocks, 21, 22 and 23 respectively, to finally the second cable attachment point 24. Details of the reeving are shown in FIG. 4.

A duplicate cable reeving system is partially shown at points 22', 23' and 24'. The remainder of the duplicate cable reeving system is the same as the already described system, but is not seen on the drawing because of structure blocking the view.

In operation, as the extensible section 2 of the derrick begins to travel upward, the racking board 10 will be allowed to move along guide rails 4 relative to the upper section until the sliding hinges 5 hit stop 9. At that point, cable which is played out as a result of the rising of the extensible section will permit the racking board to rotate from its stored position as shown in FIG. 1 to its deployed position as shown in FIG. 2. Rotating rail 12 will be allowed to rotate approximately 90 degrees to complete the safety rail around the racking board.

It will also be appreciated by one skilled in the art that the deployment of the racking board will be delayed until such time as the sliding hinges contact stop 9. The extensible section rises at a rate twice as fast as the racking platform is lowered, hence the platform is raised up approximately one half its travel relative to the extensible section prior to deployment.

Now it should be understood that some adjustment of height of rise before deployment and the speed of deployment is possible by location of the pulley blocks and/or cable attachment points. The use of a double block, as for example for pulley block 22, and moving the cable attachment point 24 to a location on the platform will accomplish still further adjustment. This would result in a higher raise of the platform prior to deployment, and a slower deployment of the platform. The speed of platform deployment may be increased by moving the attachment point closer to the pivot point. The location of stop 9 also effects the height of rise prior to deployment, as does the total extensibility of the upper section.

Having described our invention in terms of a preferred embodiment, numerous variations of the invention in sliding hinge, guide rail and stop detail, as well as in cable reeving systems, will occur to one skilled in the art. We do not wish to be limited in the scope of our invention except as claimed.

We claim:

1. An automatic delayed action platform deployment system for an extensible derrick comprising:

a platform attached to said derrick at an upper extensible section by means of at least one sliding hinge point disposed on said extensible section;

at least one slide guide for guiding said at least one hinge point and allowing relative movement of said at least one hinge point along said extensible section;

stop means disposed along said at least one slide guide for limiting said relative movement; and means for suspending said platform in a vertical stored position; and said means for suspending said platform further comprising means for lowering said platform relative to said extensible section to a point where said at least one hinge point coacts with said stop means to further prevent lowering of said platform relative to said extensible section and thereafter permit said platform to rotate about said at least one hinge point to a horizontal deployed position all in automatic response to raising of said extensible section.

2. The platform deployment system according to claim 1 wherein said platform is a racking board for a drill rig.

3. The platform deployment system according to claim 2 wherein said platform is provided with a plurality of said hinge points along one edge.

4. The platform deployment system according to claim 2 wherein a plurality of said slide guides are attached to said extensible section.

5. The platform deployment system according to claim 1 wherein said means for suspending said platform comprises a reeved cable pulley system.

6. The platform deployment system according to claim 5 further comprising:

a first cable attachment point towards the top of the lower derrick section;

a first pulley block attachment near the lower end of said extensible section and further;

a second pulley block attached to said extensible section towards the top of said extensible section;

a third pulley block attached to said platform towards its upper end when in its stored position;

a second cable attachment point located near said second pulley block; and a cable reeving from said first cable attachment point through sequentially said first, said second and said third pulley blocks to said second cable attachment point.

* * * * *